US011708949B2

(12) United States Patent
Xiao et al.

(10) Patent No.: US 11,708,949 B2
(45) Date of Patent: Jul. 25, 2023

(54) STRIP LAMP AND STRIP LAMP SYSTEM

(71) Applicants: SUZHOU OPPLE LIGHTING CO., LTD., Suzhou (CN); OPPLE LIGHTING CO., LTD., Shanghai (CN)

(72) Inventors: Liuhua Xiao, Suzhou (CN); Chaoguang Li, Suzhou (CN); Xianglan Li, Suzhou (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 17/842,734

(22) Filed: Jun. 16, 2022

(65) Prior Publication Data

US 2022/0316667 A1 Oct. 6, 2022

Related U.S. Application Data

(63) Continuation of application No. PCT/CN2020/136481, filed on Dec. 15, 2020.

(30) Foreign Application Priority Data

Dec. 19, 2019 (CN) ..... 201922293050.4

(51) Int. Cl.
*F21V 23/06* (2006.01)
*F21S 4/28* (2016.01)

(52) U.S. Cl.
CPC ..... *F21S 4/28* (2016.01); *F21V 23/06* (2013.01)

(58) Field of Classification Search
CPC ..... F21S 4/28; F21V 23/06
See application file for complete search history.

(56) References Cited

U.S. PATENT DOCUMENTS 6,805,470 B1 * 10/2004 Ward ..... F21V 31/00 362/455
2010/0020542 A1 * 1/2010 Teng ..... F21V 15/015 362/249.05

(Continued)

FOREIGN PATENT DOCUMENTS

CN 101576209 * 11/2009
CN 101576209 A 11/2009

(Continued)

OTHER PUBLICATIONS

English translation of Cai CN-206257554-U, published Jun. 2017 (Year: 2017).*

(Continued)

*Primary Examiner* — Evan P Dzierzynski
(74) *Attorney, Agent, or Firm* — Arch & Lake LLP

(57) ABSTRACT

A strip lamp includes a housing, a mask, a light source module and two end covers. The two end covers are arranged at both ends of the housing and form an accommodating chamber with the housing. The accommodating chamber extends along the length direction of the housing, and the light source module is accommodated in the accommodating chamber; the mask includes a light exiting part, a connection part formed by bending towards each other and extending from both sides of the light exiting part, and a pressing part formed at the end of the joint part. The first depression is formed between the joint part and the pressing part, two sides of the housing are extends towards each other to form a buckle part; the light source module includes a circuit board and a light emitting body arranged on the outer surface of the circuit board.

11 Claims, 5 Drawing Sheets

(56) References Cited

U.S. PATENT DOCUMENTS

| | | | | |
|---|---|---|---|---|
| 2010/0254148 | A1 | 10/2010 | Huang et al. | |
| 2013/0279160 | A1* | 10/2013 | Myers | F21V 19/003 29/825 |
| 2015/0167902 | A1* | 6/2015 | Rodgers | F21V 15/015 362/221 |
| 2016/0053973 | A1* | 2/2016 | Tress | F21S 4/28 362/217.02 |

FOREIGN PATENT DOCUMENTS

| | | | | |
|---|---|---|---|---|
| CN | 201368351 | Y | | 12/2009 |
| CN | 202532232 | U | | 11/2012 |
| CN | 103574326 | A | | 2/2014 |
| CN | 206257554 | U | * | 6/2017 |
| CN | 206257554 | U | | 6/2017 |
| CN | 207334413 | U | | 5/2018 |
| CN | 207750753 | U | | 8/2018 |
| CN | 211146154 | U | | 7/2020 |

OTHER PUBLICATIONS

English translation of Li CN-101576209 (Year: 2009).*
International Search Report of PCT Application No. PCT/CN2020/136481 dated Mar. 16, 2021 with English translation, (6p).

* cited by examiner

STRIP LAMP AND STRIP LAMP SYSTEM

CROSS REFERENCE TO RELATED APPLICATIONS

This application is based upon and claims the priority of PCT patent application No. PCT/CN 2020/136481 filed on Dec. 15, 2020, which claims priority to Chinese Patent Application No. CN 201922293050.4 filed on Dec. 19, 2019, the entire contents of both of which are hereby incorporated by reference herein for all purposes.

TECHNICAL FIELD

The present application relates to the field of lighting technology, in particular to a strip lamp and a strip lamp system.

BACKGROUND

As a commonly used lamp, the strip lamp can not only provide lighting, but also have the function of decoration. Therefore, it is more and more favored by users and has been widely used in scenic spots, office buildings, shopping malls and other environments.

SUMMARY

The present application discloses a strip lamp and a strip lamp system to solve the problem of large size of the current strip lamp.

In a first aspect, the present disclosure provides a strip lamp, which comprises a housing, a mask, a light source module and two end covers, the two end covers are arranged at two ends of the housing and form an accommodating chamber with the housing, the accommodating chamber extends along the length direction of the housing, and the light source module is accommodated in the accommodating chamber;

The mask comprises a light exiting part, a joint part formed by bending towards each other and extending from two sides of the light exiting part, and a pressing part formed at an end of the joint part. The first depression is formed between the joint part and the pressing part, two sides of the housing are extended towards each other, to form a buckle part, the buckle part is in snap-fit connection with the first depression; the light source module comprises a circuit board and a light emitting body arranged on the outer surface of the circuit board, the light emitting body is arranged facing the light exiting part, the pressing part is abutted against the outer surface of the circuit board, and at least the pressing part in the mask is an insulating material member.

In the second aspect, the present disclosure also provides a strip lamp system, which comprises at least two strip lamps as described above, wherein the male terminal connector of one strip lamp is electrically connected with the female terminal connector of the other strip lamp.

BRIEF DESCRIPTION OF THE DRAWINGS

The drawings illustrated here are used to provide a further understanding of the present disclosure and form a part of the present disclosure. The schematic embodiments of the present disclosure and descriptions thereof are used to explain the present disclosure and do not constitute an improper limitation of the present disclosure. In the drawings.

DETAILED DESCRIPTION

Figure 1:
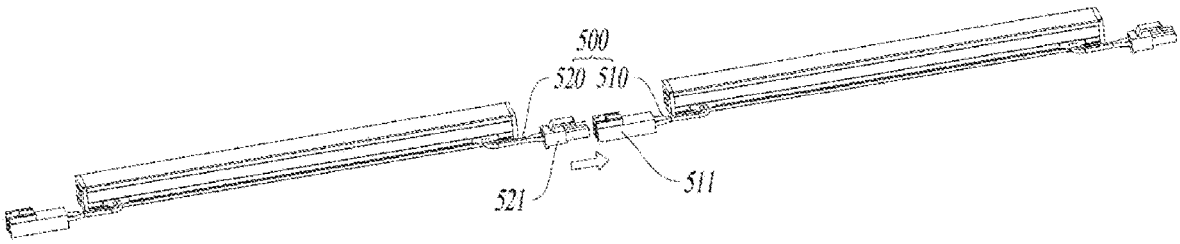
FIG. 1 is a structural diagram of a strip lamp system disclosed in an example of the present disclosure.
Figure 2:
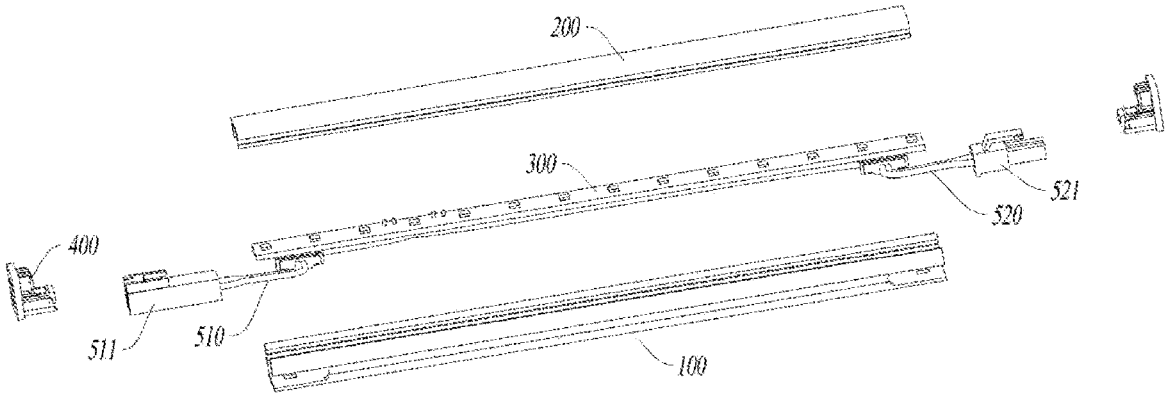
FIG. 2 is an explosive structural diagram of the strip lamp disclosed in an example of the present disclosure.
Figure 3:
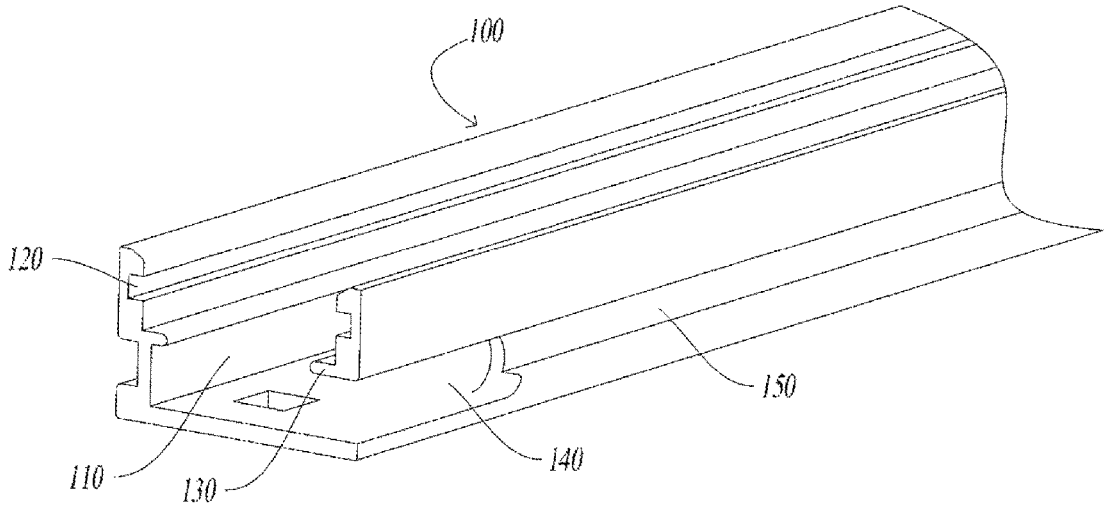
FIG. 3 is a structural diagram of a housing disclosed in an example of the present disclosure.
Figure 4:
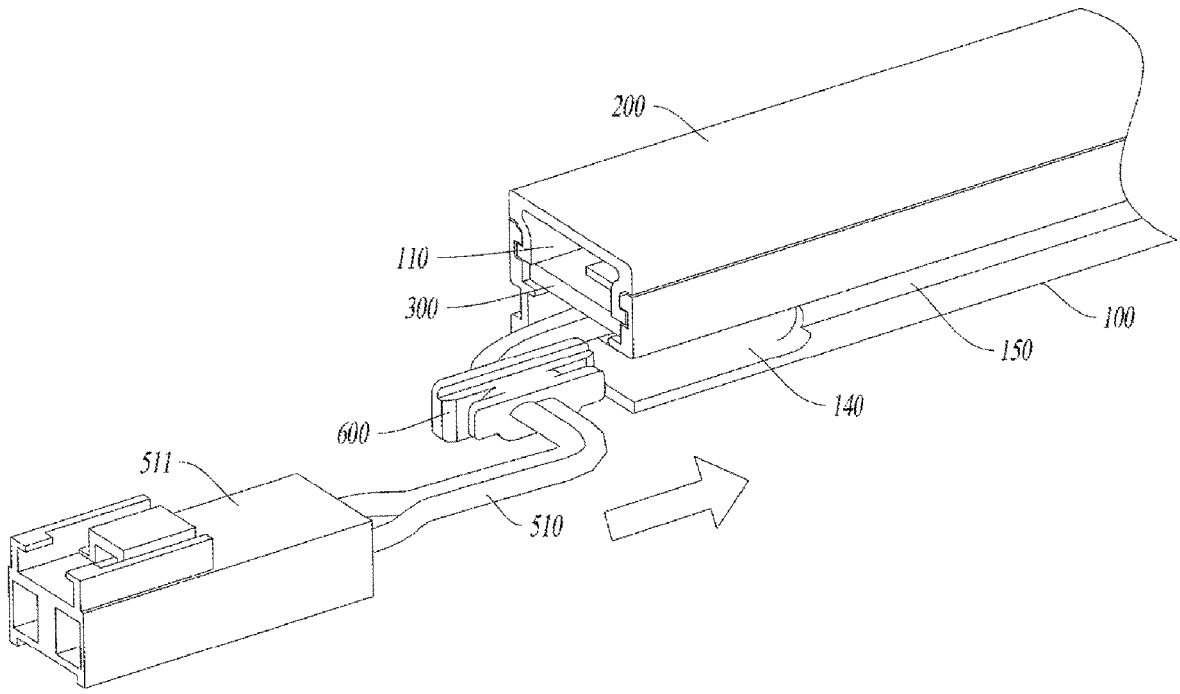
FIG. 4 is a structural diagram from one perspective of the strip lamp disclosed in an example of the present disclosure.

Examples of the present disclosure will be described below in combination with the accompanying drawings of the present disclosure. Apparently, the described examples are merely a part rather than all the examples of the present disclosure. All other examples that are derived from the examples of the present disclosure by an ordinary skilled in the art without creative efforts shall fall within the protection scope of the present disclosure. The reference numerals in the accompanying drawings are merely used to distinguish different steps in technical solutions from each other, rather than delimiting execution orders of the steps. The specific execution order may be referred to the description in the present disclosure.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

Descriptions of Attached Drawing Numerals:

100—housing, 110—accommodating chamber, 111—first accommodating groove, 112—second accommodating groove, 120—buckle part, 130—support part, 140—notch, 150—second depression,

200—mask, 210—light exiting part, 220—joint part, 230—pressing part, 240—first depression,

300—light source module, 310—circuit board, 320—light emitting body,

400—end cover, 410—end cover body, 420—first snap-fit part, 430—second snap-fit part, 440—third snap-fit part,

500—cable assembly, 510—male terminal wiring harness, 511—male terminal connector, 512—positive input wire, 513—negative input wire, 520—female terminal wiring harness, 521—female terminal connector, 522—positive output wire, 523—negative output wire,

600—wiring harness positioning structure, 610—first body part, 620—second body part, 630—connection part, 640—first slot, 650—second slot, 660—guiding part.

At present, as users' needs increase, the strip lamp presents a trend of continually increasing integration and continually shrinking appearance size. On the premise of ensuring sufficient brightness, the strip lamp needs an internal light source module to achieve sufficient power, and then requires a circuit board to have a certain width in the transverse direction, so as to have enough wiring space on the circuit board and avoid the conductive problem caused by the contact between the wiring of the circuit board and an aluminum housing or a luminous mask. The above requirements are undoubtedly contrary to the current development trend of the strip lamp. Therefore, it is urgent to improve the size of the strip lamp on the basis of taking into account the operating power of the strip lamp.

Referring to FIG. 1 to FIG. 10, the example of the present disclosure discloses a strip lamp, which comprises a housing 100, a mask 200, a light source module 300 and two end covers 400.

The housing 100 is a basic component of the strip lamp. The housing 100 can provide installation support foundation for other structures of the strip lamp, and simultaneously can also protect other structures of the strip lamp. The strip lamp is a widely used lamp, and its housing 100 is usually made of aluminum, because the aluminum profile has light quality and excellent heat dissipation performance, and the heat dissipation performance thereof is directly related to the service life of the light source module 300 in the strip lamp.

The mask 200, that is, a normal light emitting mask, is an optical element of the strip lamp and can distribute the light emitted by the light source module 300. The strip lamp also has two end covers 400, which are mainly used to improve the convenience of installation and disassembly. The light source module 300 is a light emitting component of the strip lamp. The two end covers 400 are usually arranged at both ends of the housing 100 and form an accommodating chamber 110 with the housing 100. The accommodating chamber 110 extends along the length direction of the housing 100, and the light source module 300 is accommodated in the accommodating chamber 110.

In the example of the present disclosure, the mask 200 comprises a light exiting part 210, a joint part 220 formed by bending towards each other and extending from both sides of the light exiting part 210, and a pressing part 230 formed at an end of the joint part 220. It should be understood that the light exiting part 210 is the main functional component of the mask 200, which plays a role in distributing and extracting light emitted by the light source module 300. There are two joint parts 220, which are connected with the light exiting part 210, and the two joint parts 220 are generally arranged symmetrically.

At the same time, the first depression 240 is formed between the joint part 220 and the pressing part 230, a buckle part 120 is formed by both sides of the housing 100 extending towards each other, and the buckle part 120 is in snap-fit connection with the first depression 240. It should be understood that the assembly relationship between the mask 200 and the housing 100 is realized after the buckle part 120 is in snap-fit connection with the first depression 240. Of course, the example of the present disclosure does not limit the specific types of the first depression 240 and the buckle part 120. For example, the first depression 240 may be a chute, a fixture block with a depression, etc., and the buckle part 120 may be a convex strip, a convex block, etc.

The light source module 300 comprises a circuit board 310 and a light emitting body 320 arranged on the outer side surface of the circuit board 310. Generally, the light emitting body 320 may be preferably an LED light emitting body, which has the advantages of environmental protection, energy saving, long service life and the like. The light emitting body 320 is arranged opposite to the light emitting unit 210, that is, it is convenient for the light emitted by the light emitting body 320 to irradiate the light exiting part 210.

The pressing part 230 presses against the outer surface of the circuit board 310, that is, the pressing part 230 can press the circuit board 310, so as to ensure the stable installation of the light source module 300 in the housing 100. At least the pressing part 230 in the mask 200 is an insulating material member. It should be understood that when the pressing part 230 is an insulating material member, the wiring space on the circuit board 310 can be expanded to be abutted against the pressing part 230 without the risk of conduction.

As can be seen from the above description, in the example of the present disclosure, the light source module 300 is accommodated in the housing 100, and the mask 200 is provided with the pressing part 230. The mask 200 is abutted against the surface of the circuit board 310 through the pressing part 230, and the circuit board 310 is pressed against the housing 100. At least the pressing part 230 in the mask 200 is an insulating material member. In this case, the wiring on the circuit board 310 may be in direct contact with the pressing part 230, thereby expanding the wiring space on the circuit board 310. At the same time, the pressing part 230 is an insulating material member, and there will be no conductive problem.

Compared with the prior art, under the condition of ensuring sufficient power, it is also considered that an anti-conductive space should be left between the wiring on the circuit board and the mask and between the wiring on the circuit board and the housing, so as to make the overall size of the lamp large. The strip lamp disclosed in the example of the present disclosure can not only expand the wiring space on the circuit board 310 and ensure that the light source module has sufficient power without increasing the size of the strip lamp, but also has no conductive problem.

Figure 5:
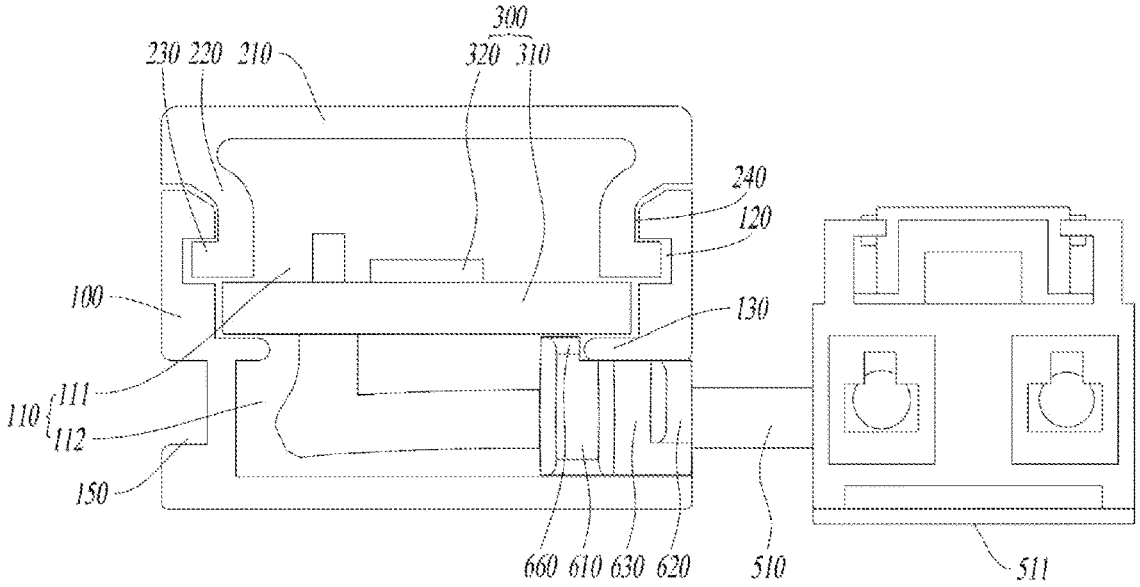
FIG. 5 is a left view of FIG. 4.

Referring to FIG. 5, in the example of the present disclosure, the accommodating chamber 110 may be provided with two support parts 130 formed by the middle side wall of the housing 100 extending facing to each other, and the two support parts 130 separate the accommodating chamber 110 into the first accommodating groove 111 and the second accommodating groove 112 in the depth direction. It should be understood that the example of the present disclosure does not limit the specific protruded position of the support part 130 on the side wall of the housing 100. The support part 130 may be protruded out from the directly middle position of the side wall of the housing 100 or from any position in a range floating up and down from the directly middle position of the side wall of the housing 100. In the example of the present disclosure, the shape types of the support part 130 may be various, which may be in the shape of a partition plate, a convex strip, or a convex block arranged at intervals.

The first accommodating groove 111 is used to accommodate the light source module 300, that is, the light source module 300 is installed in the first accommodating groove 111, and the support part 130 is supported on the inner surface of the circuit board 310. Specifically, the circuit board 310 is supported by the support part 130 and the housing 100. The second accommodating groove 112 is used to accommodate a cable assembly 500, which is electrically connected with the light source module 300. It should be understood that the cable assembly 500 provides an external power supply for the light source module 300.

Figure 7:
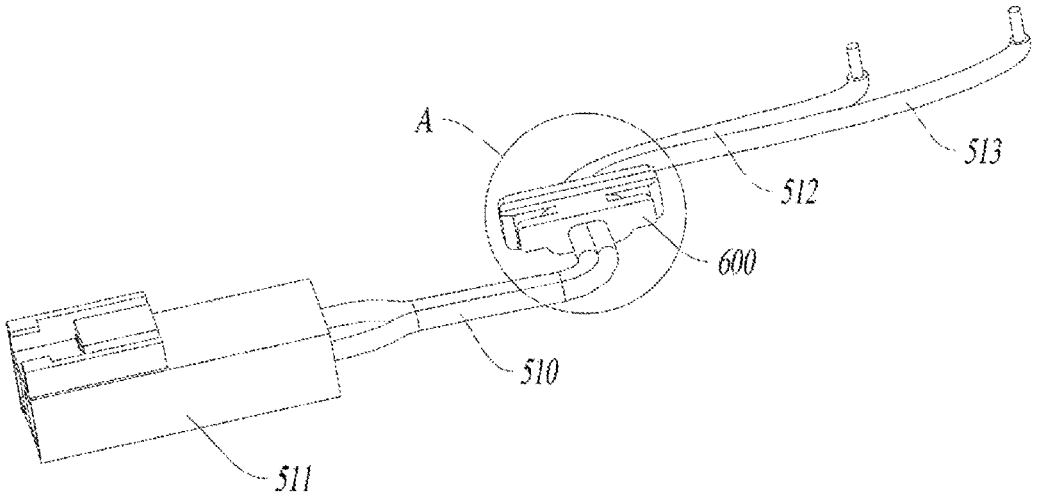
FIG. 7 is a structural diagram of a male terminal wiring harness disclosed in an example of the present disclosure.

Referring to FIG. 7, in a specific example, the cable assembly 500 may comprise a male terminal wiring harness 510, the first end of the male terminal wiring harness 510 is electrically connected with the light source module 300, the second end of the male terminal wiring harness 510 extends outside the housing 100, and the second end of the male terminal wiring harness 510 is connected with a male terminal connector 511. In the specific use process, only the male terminal connector 511 needs to be connected with the external power supply to supply power to the light source module 300, and the light source module 300 can be used normally.

At present, there is also a usage way in which a plurality of strip lamps are connected in series. If the above electrical connection way is adopted, a plurality of external power supplies are required. Based on this, please refer to FIG. 9, in a solution, the cable assembly 500 may also comprise a female terminal wiring harness 520, the first end of the female terminal wiring harness 520 is electrically connected with the light source module 300, the second end of the female terminal wiring harness 520 extends outside the housing 100, and the second end of the female terminal wiring harness 520 is connected with a female terminal connector 521.

In the specific use process, it is necessary to connect the male terminal connector 511 of the first strip lamp with the external power supply, and connect the female terminal connector 521 of the first strip lamp with the male terminal connector 511 of the second strip lamp, so as to supply power to the first two strip lamps at the same time, and the subsequent connection way is the same as that of the first two strip lamps. In this way, the power supply of the strip lamp used is finally realized, which can be used together without a plurality of external power supplies.

Referring to FIG. 7 and FIG. 9 again, generally, the male terminal wiring harness 510 comprises at least a positive input wire 512 and a negative input wire 513, and the positive input wire 512 and the negative input wire 513 are in parallel wiring state; the female terminal wiring harness 520 comprises at least a positive output wire 522 and a negative output wire 523, and the positive output wire 522 and the negative output wire 523 are in parallel wiring state.

Compared with the existing wiring arrangement manner, the positive input wire 512 and the negative input wire 513 are scattered and twisted together, and the positive output wire 522 and the negative output wire 523 are also scattered and twisted together, so as to make the overall volume of the wiring harness large. The parallel wiring method adopted by the example of the present disclosure makes the male terminal wiring harness 510 and the female terminal wiring harness 520 only occupy a small space of the second accommodating groove 112, especially in the height direction. Therefore, the height size of the second accommodating groove 112 can be small, and finally the reduction of the size in the height direction of the strip lamp can be realized. It should be noted that the parallel wiring refer to two or more wirings with exactly the same specification, form and cross-sectional area operating in parallel manner.

Referring to FIG. 3~FIG. 6, since the cable assembly 500 is led out from a hole after the hole is opened on the strip lamp, the cable assembly 500 is not fixed. If the cable assembly 500 is pulled, the relative displacement between the cable assembly 500 and the housing 100 is easy to occur, and even the cable assembly 500 is damaged, so the power cannot be normally provided. Based on this, in a preferred solution, the strip lamp may also comprise a wiring harness positioning structure 600. The wiring harness positioning structure 600 is sleeved on the cable assembly 500, and the wiring harness positioning structure 600 is positioned and matched with the housing 100. It should be understood that in the case, when the cable assembly 500 is pulled, because the wiring harness positioning structure 600 is positioned and matched with the housing 100, it will restrict the cable assembly 500 and avoid the relative displacement of the cable assembly 500 with the housing 100 due to being pulled.

As mentioned previously, the current strip lamp has a method of using a plurality of strip lamps connected in series. When using such manner, the every two strip lamps will be connected at the end cover through a connector, so that a plurality of strip lamps can be connected as a whole and different angles can be changed; thereby, a wiring method of leading out the cable assembly 500 from the side of the housing 100 is generated.

In a specific example, the port of the housing 100 may be provided with a notch 140, and the notch 140 is located on the side wall of the housing 100 in the second accommodating groove 112. The wiring harness positioning structure 600 is arranged at the notch 140, one end of the wiring harness positioning structure 600 is inserted and matched with the side wall of the housing 100 in the second accommodating groove 112, and the other end of the wiring harness positioning structure 600 is inserted and matched with one of the two end covers 400. It should be understood that the notch 140 is the installation region of the wiring harness positioning structure 600, and this arrangement can lead out the cable assembly 500 from the side wall of the housing 100; at the same time, both ends of the wiring harness positioning structure 600 are assembled with the housing 100 and the end cover 400, respectively. Of course, the example of the present disclosure does not limit the specific connection relationship of the wiring harness positioning structure 600. For example, the wiring harness positioning structure 600 may also be a matching relationship of bonding and threaded connection.

Figure 8:
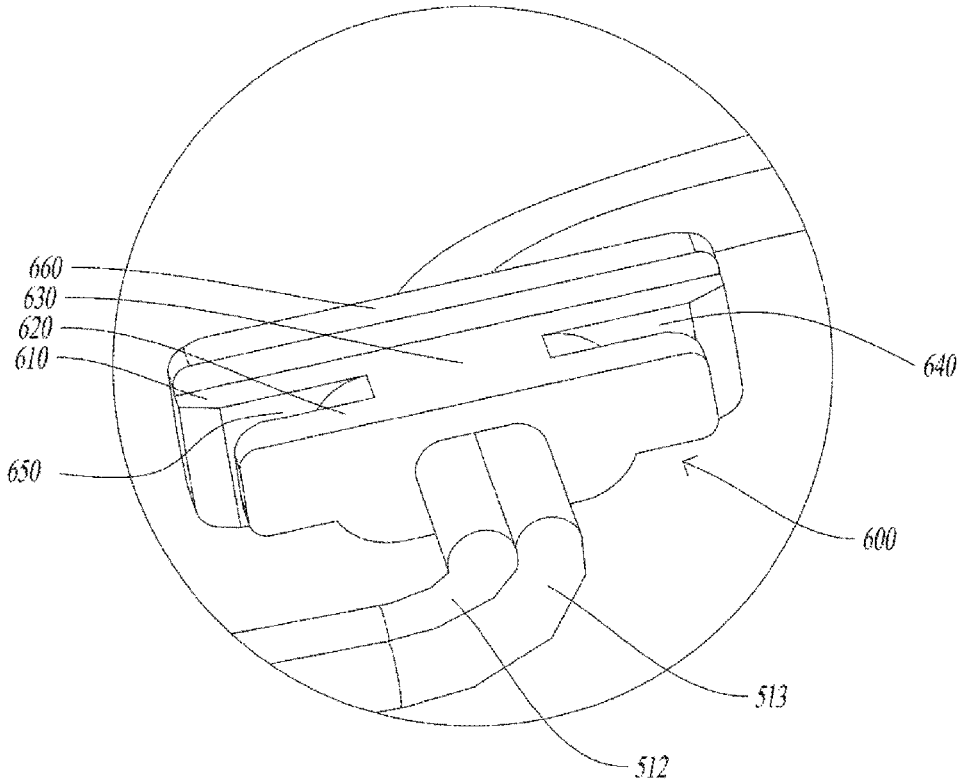
FIG. 8 is a partial enlarged view at A in FIG. 7.
Figure 9:
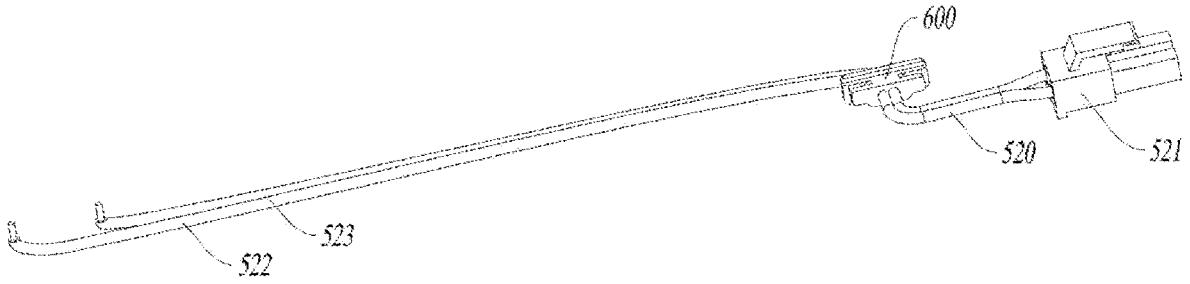
FIG. 9 is a structural diagram of a female terminal wiring harness disclosed in an example of the present disclosure.

Referring to FIG. 8, in a specific example, the wiring harness positioning structure 600 may comprise the first body part 610, the second body part 620 which is parallel to and spaced from the first body part 610, and a connection part 630 between the first body part 610 and the second body part 620. The first body part 610 and the second body part 620 are connected through the connection part 630, the first body part 610 and the second body part 620 are in a flat plate shape, and the area of the first body part 610 is larger than that of the second body part 620. The first body part 610, the second body part 620 and the connection part 630 are spaced to form the first slot 640 and the second slot 650 that face away from each other. The first slot 640 and the side wall of the housing 100 at the second accommodating groove 112 are in inserting connection, and the second slot 650 is in inserting connection with one of the two end covers 400.

In this case, the assembling of the wiring harness positioning structure 600 with the housing 100 and the end cover 400 is realized. In the actual inserting connection, the two ends of the first body part 610 and the second body part 620 are usually abutted against the bottom plates of the support part 130 and the second accommodating groove 112, so the connection relationship will be more stable, but the example of the present disclosure does not limit this.

In order to further improve the connection stability of the wiring harness positioning structure 600, in a preferred solution, the housing 100 may be provided with the second depression 150 on the side wall of the second accommodating groove 112, and the second depression 150 is connected with the notch 140. When the first slot 640 is in inserting connection with the side wall of the housing 100 in the second accommodating groove 112, the second body part 620 enters the second depression 150, and is limited in the depth direction of the second depression 150. In the specific use process, the second depression 150 will restrict the second body part 620, which is indirectly manifested as a clamping effect, which can not only play a limiting role in the depth direction, but also prevent the second body part 620 from loosening from the second depression 150, and finally prevent the wiring harness positioning structure 600 from separating from the housing 100.

In order to further improve the connection stability of the wiring harness positioning structure 600, in a more preferred solution, a guiding part 660 may be arranged on a side of the first body part 610 facing the first accommodating groove 111, and the guiding part 660 is abutted against the support part 130. It should be understood that the size of the support part 130 should not exceed the size range of the wiring harness positioning structure 600, so that the guiding part 660 can realize the abutting relationship with the support part 130. In the specific use process, when the wiring harness positioning structure 600 is in inserting connection with the side wall of the housing 100 at the second accommodating groove 122 through the first slot 640, the guiding part 660 is first abutted against the support part 130, and then the wiring harness positioning structure 600 slides inward on the support part 130 through the guiding part 660. At this time, the first slot 640 faces exactly the side wall of the housing 100 in the second accommodating groove 122, which can achieve the inserting connection one time by using one alignment and avoid the problem of trying again and again without alignment.

Figure 6:
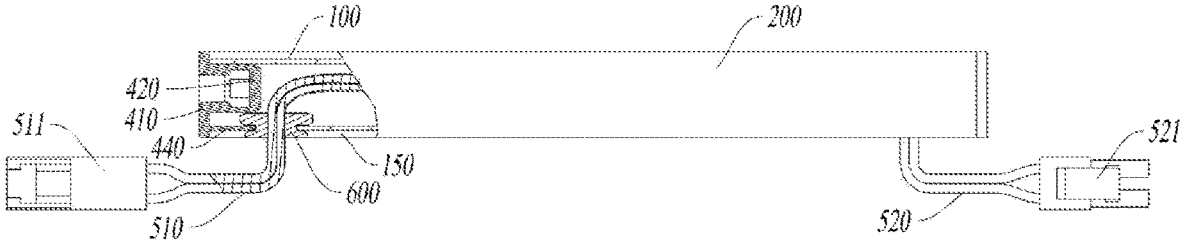
FIG. 6 is a partial cross-sectional view from another perspective of the strip lamp disclosed in an example of the present disclosure.
Figure 10:
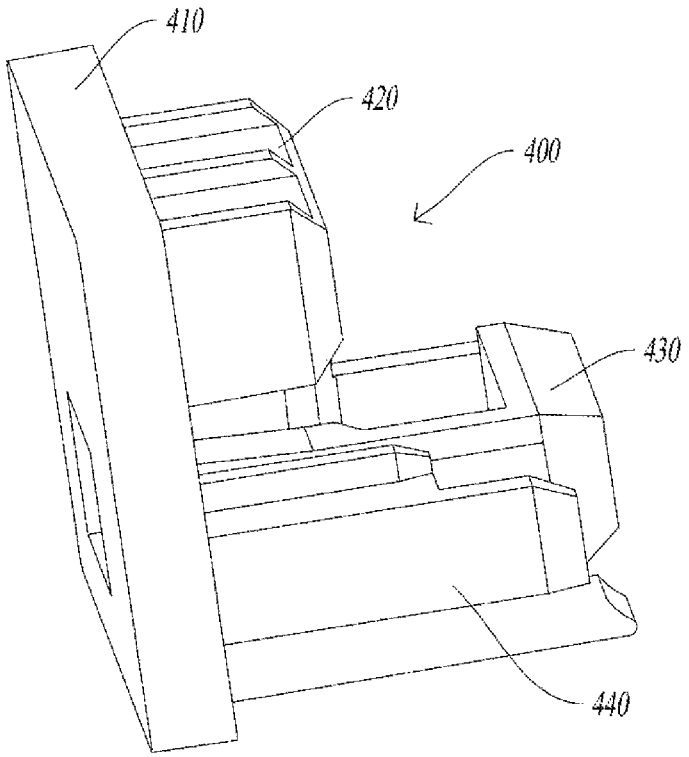
FIG. 10 is a structural diagram of an end cover disclosed in an example of the present disclosure.

In the example of the present disclosure, there can be a variety of matching relationships between the end cover 400 and the mask, the housing and the wiring harness positioning structure 600, which are not limited by the example of the present disclosure. Referring to FIG. 6 and FIG. 10, in a more preferred solution, the end cover 400 may comprise an end cover body 410, the first snap-fit part 420, the second snap-fit part 430 and the third snap-fit part 440 extending from the end surface of the end cover body 410. The first snap-fit part 420 is located on the upper side of the second snap-fit part 430 and the third snap-fit part 440, and the second snap-fit part 430 is spaced from the third snap-fit part 440; the first snap-fit part 420 is in snap-fit connection between the light exiting part 210 and the circuit board 310, the first snap-fit part 420 is abutted against the joint part 220, the second snap-fit part 430 is in snap-fit connection between the first body part 610 and the side wall of the housing 100 facing the first body part 610, and the second snap-fit part 430 is abutted against the support part 130. The third snap-fit part 440 is in a flat plate shape, and the third snap-fit part 440 is in inserting connection with the second slot 650.

Specifically, the first snap-fit part 420 is in snap-fit connection between the light exiting part 210 and the circuit board 310. The first snap-fit part 420 is fixed and restrained, so that it will not loosen, and it will not be displaced due to the restriction of the joint part 220 in the width direction at the same time; the second snap-fit part 430 is clamped between the first body part 610 and the side wall of the housing 100 facing the first body part 610. The second snap-fit part 430 is fixed and restrained, it will not be loosen, and it will not be displaced due to the restriction of the support part 130 in the depth direction at the same time; the third snap-fit part 440 is clamped in the second slot 650 to achieve a stable connection, and at the same time, the third snap-fit part 440 also exerts a pressing force on the wiring harness positioning structure 600. In summary, the assembly of the end cover 400 is realized.

Based on the strip lamp, the example of the present disclosure also discloses a strip lamp system, which comprises at least two strip lamps as described above, in which the male terminal connector 511 of one strip lamp is electrically connected with the female terminal connector 521 of another strip lamp.

The technical solution adopted by the present disclosure can achieve the following beneficial effects:

In an example of the present disclosure, the light source module is accommodated in the housing, the mask comprises a pressing part, the mask is abutted against the surface of the circuit board through the pressing part, and the circuit board is pressed against the housing, and at least the pressing part in the mask is an insulating material member. In this case, the wiring on the circuit board can directly contact the pressing part, which further expands the wiring space on the circuit board. At the same time, the pressing part is an insulating material member, which also avoids the problem of conductivity.

Compared with the prior art, under the condition of ensuring sufficient power, it is also considered that the wiring on the circuit board should leave an anti-conductive space with the mask and the housing, so as to make the overall size of the lamp larger. The strip lamp disclosed in the examples of the present disclosure can not only expand the wiring space on the circuit board and ensure that the light source module has sufficient power without increasing the size of the strip lamp, but also has no conductive problem.

The above examples of the present disclosure focus on the differences between various examples. As long as the different optimization features between the various examples are not contradictory, they may be combined to form a better example. In consideration of the simplicity of the text, they will not be repeated here.

The above are only examples of the present disclosure and are not used to limit the present disclosure. For those skilled in the art, the present disclosure may have various modifications and changes. Any modification, equivalent replacement, improvement, etc. made within the spirit and principle of the present disclosure shall be comprised in the scope of the claims of the present disclosure.

What is claimed is:

1. A strip lamp, comprising a housing, a mask, a light source module, a wiring harness positioning structure and two end covers, the two end covers are arranged at two ends of the housing and form an accommodating chamber with the housing, the accommodating chamber extends along a length direction of the housing, and the light source module is accommodated in the accommodating chamber;

the mask comprises a light exiting part, a joint part formed by bending towards each other and extending from two sides of the light exiting part, and a pressing part formed at an end of the joint part, a first depression is formed between the joint part and the pressing part, and two sides of the housing are extended towards each other, to form a buckle part, the buckle part is in snap-fit connection with the first depression; the light source module comprises a circuit board and a light emitting body arranged on an outer surface of the circuit board, the light emitting body is arranged facing the light exiting part, and the pressing part is abutted against an outer surface of the circuit board, and at least the pressing part in the mask is an insulating material member, wherein, middle side walls of the housing are extended facing to each other to form two support parts, the two support parts are provided in the accommodating chamber and separate the accommodating chamber into a first accommodating groove and a second accommodating groove in a depth direction, and the first accommodating groove is configured to accommodate the light source module, the support part is supported on an inner surface of the circuit board, the second accommodating groove is configured to accommodate a cable assembly, and the cable assembly is electrically connected with the light source module, wherein, a port of the housing is provided with a notch, the notch is located at a side wall of the housing in the second accommodating groove, the wiring harness positioning structure is arranged at the notch, one end of the wiring harness positioning structure is in inserting connection with the side wall of the housing in the second accommodating groove, and another end of the wiring harness positioning structure is in inserting connection with one of the two end covers.

2. The strip lamp according to claim 1, wherein, the cable assembly comprises a male terminal wiring harness, a first end of the male terminal wiring harness is electrically connected with the light source module, a second end of the male terminal wiring harness extends outside the housing, and the second end of the male terminal wiring harness is connected with a male terminal connector.

3. The strip lamp according to claim 2, wherein, the cable assembly further comprises a female terminal wiring harness, a first end of the female terminal wiring harness is electrically connected with the light source module, a second end of the female terminal wiring harness extends outside the housing, and the second end of the female terminal wiring harness is connected with a female terminal connector.

4. The strip lamp according to claim 3, wherein, the male terminal wiring harness comprises at least a positive input wire and a negative input wire, and the positive input wire and the negative input wire are in parallel wiring state; the female terminal wiring harness comprises at least a positive output wire and a negative output wire, and the positive output wire and the negative output wire are in parallel wiring state.

5. A strip lamp system, wherein, the strip lamp system comprises at least two strip lamps according to claim 3, the male terminal connector of one strip lamp is electrically connected with the female terminal connector of another strip lamp.

6. The strip lamp according to claim 1, wherein the wiring harness positioning structure is sleeved on the cable assembly, and the wiring harness positioning structure is positioned and matched with the housing.

7. The strip lamp according to claim 6, wherein, the wiring harness positioning structure comprises a first body part, a second body part parallel to and spaced apart from the first body part, and a connection part between the first body part and the second body part, the first body part is connected with the second body part through the connection part, the first body part and the second body part are in a flat plate shape, an area of the first body part is greater than an area of the second body part, the first body part, the second body part and the connection part are spaced from each other to form a first slot and a second slot facing away from each other, the first slot is in inserting connection with a side wall of the housing in the second accommodating groove, and the second slot is in inserting connection with one of the two end covers.

8. The strip lamp according to claim 7, wherein, a side wall of the housing is provided with a second depression at the second accommodating groove, the second depression is communicated with the notch, under a condition that the first slot is in inserting connection with the side wall of the housing in the second accommodating groove, the second body part enters the second depression and is limited in a depth direction of the second depression.

9. The strip lamp according to claim 7, wherein, a guiding part is arranged at a side of the first body part towards the first accommodating groove, and the guiding part is abutted against the support part.

10. The strip lamp according to claim 7, wherein, the end cover comprises an end cover body, a first snap-fit part, a second snap-fit part and a third snap-fit part extending from an end surface of the end cover body, the first snap-fit part is located on an upper side of the second snap-fit part and the third snap-fit part, the second snap-fit part is spaced away from the third snap-fit part; the first snap-fit part is in snap-fit connection between the light exiting part and the circuit board, the first snap-fit part is abutted against the joint part, the second snap-fit part is in snap-fit connection between the first body part and a side wall of the housing facing the first body part, the second snap-fit part is abutted against the support part, the third snap-fit part is in a flat plate shape, and the third snap-fit part is in inserting connection with the second slot.

11. A strip lamp system, wherein the strip lamp system comprises at least two strip lamps, and each of the at least two strip lamps comprises:

a housing, a mask, a light source module, a wiring harness positioning structure and two end covers, the two end covers are arranged at two ends of the housing and form an accommodating chamber with the housing, the accommodating chamber extends along a length direction of the housing, and the light source module is accommodated in the accommodating chamber;

the mask comprises a light exiting part, a joint part formed by bending towards each other and extending from two sides of the light exiting part, and a pressing part formed at an end of the joint part, a first depression is formed between the joint part and the pressing part, and two sides of the housing are extended towards each other, to form a buckle part, the buckle part is in snap-fit connection with the first depression; the light source module comprises a circuit board and a light emitting body arranged on an outer surface of the circuit board, the light emitting body is arranged facing the light exiting part, and the pressing part is abutted against an outer surface of the circuit board, and at least the pressing part in the mask is an insulating material member, wherein, middle side walls of the housing are extended facing to each other to form two support parts, the two support parts are provided in the accommodating chamber and separate the accommodating chamber into a first accommodating groove and a second accommodating groove in a depth direction, and the first accommodating groove is configured to accommodate the light source module, the support part is supported on an inner surface of the circuit board, the second accommodating groove is configured to accommodate a cable assembly, and the cable assembly is electrically connected with the light source module, wherein, a port of the housing is provided with a notch, the notch is located at a side wall of the housing in the second accommodating groove, the wiring harness positioning structure is arranged at the notch, one end of the wiring harness positioning structure is in inserting connection with the side wall of the housing in the second accommodating groove, and another end of the wiring harness positioning structure is in inserting connection with one of the two end covers.

* * * * *